United States Patent [19]

Muramatsu et al.

[11] 4,330,224

[45] May 18, 1982

[54] COLLAPSIBLE RUBBER DAM INSTALLATION

[75] Inventors: Tateo Muramatsu, Yokohama; Mamoru Kurihara, Tokyo, both of Japan

[73] Assignee: Bridgestone Tire Company Limited, Tokyo, Japan

[21] Appl. No.: 126,749

[22] Filed: Mar. 3, 1980

[30] Foreign Application Priority Data

| | | | |
|---|---|---|---|
| Mar. 20, 1979 | [JP] | Japan | 54-33031 |
| Mar. 28, 1979 | [JP] | Japan | 54-35422 |
| May 24, 1979 | [JP] | Japan | 54-64299 |
| Jul. 13, 1979 | [JP] | Japan | 54-95625[U] |
| Jul. 31, 1979 | [JP] | Japan | 54-96719 |

[51] Int. Cl.[3] ..... E02B 7/02

[52] U.S. Cl. ..... 405/115; 405/90

[58] Field of Search ..... 405/115, 90, 87, 80

[56] References Cited

U.S. PATENT DOCUMENTS 3,173,269 3/1965 Imbertson ..... 405/115 X

FOREIGN PATENT DOCUMENTS 623188 9/1978 U.S.S.R. ..... 405/115

*Primary Examiner*—Dennis L. Taylor

*Attorney, Agent, or Firm*—Sughrue, Mion, Zinn, Macpeak & Seas

[57] ABSTRACT

A collapsible rubber dam installation comprising a rubber dam built across a watercourse such as a river or the like and operative to be raised by supplying fluid such as air, water or the like. The dam is collapsed by discharging the fluid therein into atmosphere. A fluid supply and discharge conduit have one end connected to the inside of the rubber dam at a position which is higher than at least a level of drain collected therein and have the other end extending substantially upwardly with an ascending inclination.

8 Claims, 34 Drawing Figures

COLLAPSIBLE RUBBER DAM INSTALLATION

BACKGROUND OF THE INVENTION

1. Field of the Invention

This invention relates to a collapsible rubber dam installation comprising a rubber dam built across a watercourse such as a river or the like and operative to be raised by supplying fluid such as air, water or the like thereinto and to be collapsed by discharging the fluid filled therein to atmosphere.

2. Description of the Prior Art

Collapsible rubber dam installations have been applied to agricultural water taking dams, rising tide preventive dam, sea water obstructing dam or the like. Heretofore, it has been the common practice to supply fluid into a collapsible rubber dam to raise it and discharge the fluid filled therein into atmosphere to collapse it by means of a pipe line installation composed of a horizontal pipe embedded in a riverbed on which is disposed the rubber dam and a plurality of branch pipes for connecting the horizontal pipe to the rubber dam. In addition, a fluid suction and exhaust device such as a pump, an exhaust opening or the like connected to the horizontal pipe are arranged in a control room located at one of river banks.

In such conventional collapsible rubber dam installation, fluid is supplied under pressure through the horizontal pipe and branch pipes into the rubber dam by means of a pump or the like for the purpose of raising the rubber dam. In this case, the water content contained in the fluid supplied under pressure is condensed into drainage which is collected in the rubber dam and pipe lines. Particularly, the drain is collected in the horizontal pipe embedded in the riverbed. As a result, in order to collapse the rubber dam by discharging fluid filled therein into atmosphere, it is necessary to open a first valve connected to the horizontal pipe for the purpose of extracting the drain collected therein and then to open a second valve connected through a vertical pipe to the first valve for the purpose of extracting the fluid filled in the rubber dam. Thus, a conventional collapsible rubber dam installation has the disadvantage that it is difficult to inflate and collapse the rubber dam and that such rubber dam inflating and collapsing operation is not efficient.

In addition, in case of emergency where the amount of flow of the river water becomes abnormally increased due to a flood or the like, it is usual to automatically open a float valve to discharge fluid filled in the rubber dam into atmosphere and hence automatically collapse the rubber dam. In this case, the conventional rubber dam installation provides the important drawback that it is impossible to discharge the fluid filled in the rubber dam owing to the presence of the drain produced by the condensation phenomenon and collected in the pipe lines. As a result, the rubber dam could not be collapsed.

SUMMARY OF THE INVENTION

An object of the invention, therefore, is to provide a collapsible rubber dam installation which can eliminate the above mentioned drawbacks which have been encountered with the prior art techniques and which can prevent pipe lines from being collected with drainage such that the rubber dam can be collapsed by discharging fluid filled therein into atmosphere at any desired time.

A feature of the invention is the provision in a collapsible rubber dam installation comprising a rubber dam built across a watercourse such as a river or the like and operative to be inflated by supplying fluid such as air or the like into the rubber dam and to be collapsed by discharging the fluid filled therein into atmosphere. The improvement comprises one end of a fluid supply and discharge conduit is connected to the inside of said rubber dam at a position which is higher than at least a level of drain collected therein. The other end of the conduit is extended substantially upwardly with an ascending inclination.

Further objects and features of the invention will be fully understood from the following detailed description with reference to the accompanying drawings, wherein:

DETAILED DESCRIPTION OF THE PREFERRED EMBODIMENTS

Figure 1:
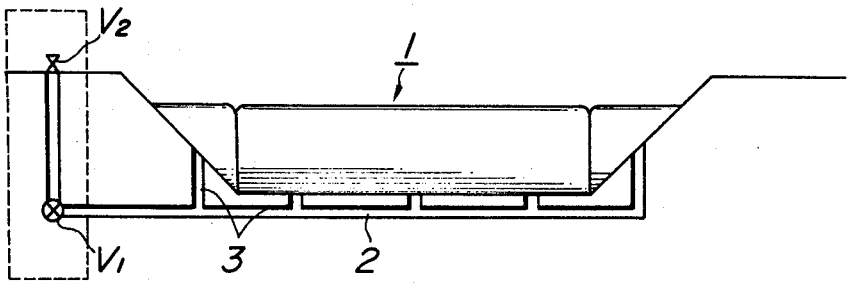
FIG. 1 PRIOR ART
FIG. 1 is a transverse cross-sectional view of a conventional collapsible rubber dam installation.

FIG. 1 shows a conventional collapsible rubber dam installation. In FIG. 1, reference numeral 1 designates a rubber dam, 2 a horizontal pipe embedded in a riverbed, and 3 a plurality of branch pipes for connecting the horizontal pipe 2 to the rubber dam 1. A fluid supply and discharge device such as a pump, outlet opening or the like connected to the horizontal pipe 2 are arranged in a control room provided at one of the riversides and shown by dotted lines.

In the collapsible rubber dam installation shown in FIG. 1, in order to raise the rubber dam 1, fluid such as air or the like is supplied under pressure through the horizontal pipe 2 and branch pipes 3 into the rubber dam 1 by means of a pump or the like. In this case, the water content contained in the fluid is condensed into drainage which is collected in the rubber dam 1 and pipe lines, particularly in the horizontal pipe 2. As a result, in the case of collapsing the rubber dam by discharging fluid filled therein into atmosphere, it is necessary to open a valve $V_1$ to extract the drain collected in the horizontal pipe 2 and then to open a valve $V_2$ to discharge the fluid filled in the rubber dam 1 into atmosphere. As seen from the above, the conventional rubber dam installation has the disadvantage that the operation of collapsing the rubber dam is troublesome and not efficient.

In addition, the conventional collapsible rubber dam installation shown in FIG. 1 has another disadvantage that it is impossible to discharge the fluid filled in the rubber dam into atmosphere and collapse it due to the presence of the drainage produced due to the condensation phenomenon of the water content contained in the fluid and collected in the pipe lines so that in case of emergency where the amount of flow of water in the river is abnormally increased due to a flood or the like and the rubber dam must automatically be collapsed by automatically opening a float valve and discharging the fluid in the rubber dam into atmosphere.

Figure 2:
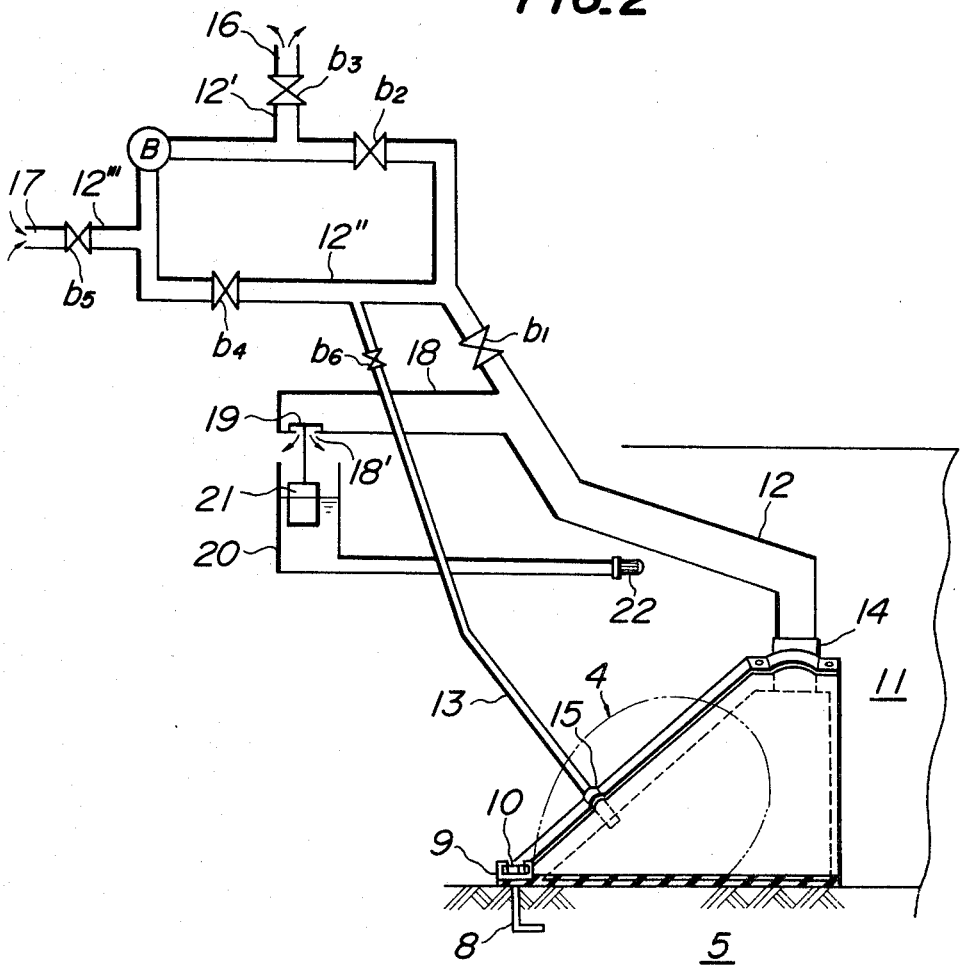
FIG. 2 is a longitudinal cross-sectional view of a first embodiment of a collapsible rubber dam installation according to the invention.

FIG. 2 shows a first embodiment of a collapsible rubber dam installation according to the invention which can eliminate the above mentioned drawbacks. In FIG. 2, reference numeral 4 designates a rubber dam arranged on a riverbed 5 and operative to be raised by introducing fluid such as air, water or the like thereinto. For the rubber dam, use may be made of a bag-shaped sheet body formed of rubber. In the embodiment shown in FIG. 2, use is made of a rubber dam into which is supplied fluid and from which is discharged it by means of a single conduit.

Figure 3:
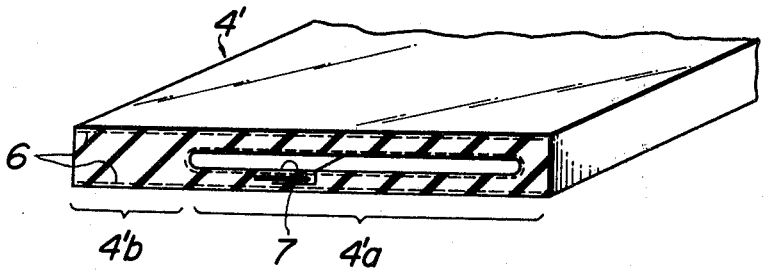
FIG. 3 is a perspective view of one example of a rubber dam body, partly shown in section.

FIG. 3 shows a preferred example of the rubber dam shown in FIG. 2.

In FIG. 3, reference numeral 4' designates a rubber dam body reinforced with a canvas 6. The rubber dam body 4' is composed of an inflation portion 4'*a* operative to be inflated into a tubular body by supplying fluid such as air, water or the like thereinto, a plate-shaped portion 4'*b* extending along the lengthwise direction of the rubber dam body 4' and made integral with one side thereof, and an auxiliary air chamber 7 formed in the inner wall portion of the inflation portion 4'*a* and having a diameter which is far smaller than the diameter of the inflation portion 4'*a*.

The rubber dam body 4' shown in FIG. 3 is suitably used for the rubber dam installation according to the invention, but the invention is not limited only to such rubber dam body. For example, use may be made of a rubber dam body provided with a groove formed in the inner wall of the inflation portion 4'*a* in place of the auxiliary air chamber 7, a rubber dam body not provided with the auxiliary air chamber 7 or the like.

The rubber dam body 4' shown in FIG. 3 may be manufactured as follows. On a hot surface plate of a mold plate are superimposed two raw material green rubber sheets one upon the other. A mold releasing agent is disposed in a region for defining the inflation portion 4'*a* and auxiliary air chamber 7 interposed between the above mentioned raw material green rubber sheets and extending along the lengthwise direction of the rubber dam body 4'. Then, the raw material green rubber sheets are pressed together into one integral body at a vulcanizing temperature. The rubberized canvas 6 or the like is embedded in the raw material green rubber sheet so as to obtain a desired reinforcing layer.

Figure 4:
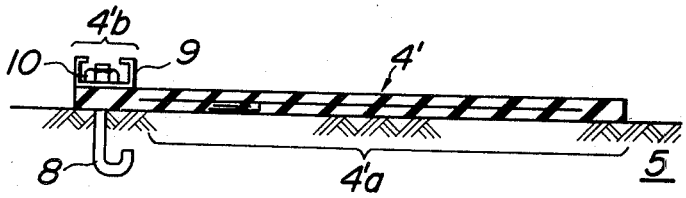
FIG. 4 is a cross-sectional view of the rubber dam body shown in FIG. 3 and secured to the riverbed.

FIG. 4 shows how to secure the rubber dam body 4' to the riverbed 5. As shown in FIG. 4, an anchor bolt 8 is embedded beforehand in the riverbed 5 and extends through a hole provided in the plate-shaped portion 4'*b* of the rubber dam body 4' located at its upper stream side. Then, the plate-shaped portion 4'*b* is firmly fastened to the riverbed 5 through a holding plate 9 by means of a nut 10 threadedly engaged with the anchor bolt 8. In addition, the two end portions of the rubber dam body 4' are secured to the riversides 11 shown in FIG. 2, respectively, in the same manner as described with reference to FIG. 5.

In this way, the pipe line shown in FIG. 2 is connected to near the end portion of the rubber dam body 4' secured to the riverside 11. That is, conducts 12, 13 are hermetrically connected to an inlet opening 14 of the inflation portion 4'*a* and to an inlet opening 15 of the auxiliary air chamber 7, respectively. In FIG. 2, the conduit 12 functions to supply the fluid into the inflation portion 4'*a* and discharge it therefrom to atmosphere. Provision may be made of a conduit exclusively supplying the fluid into the inflation portion 4'*a* and the conduit 12 may be used only for discharging the fluid from the inflation portion 4'*a*, if necessary.

In general, fluid such as air, water or the like supplied into the rubber dam 4 contains water which becomes condensed into drainage under various weather conditions. The drainage thus produced is collected in the base portion of the rubber dam. In the present invention, that connection opening of the rubber dam which is connected to the fluid discharge conduit is located at a position which is higher than the height of the drainage collected in the base portion of the rubber dam body 4'. In the rubber dam, the allowable height of the drainage collected in the base portion of the rubber dam body 4' is 10% of the height of the raised rubber dam. As a result, the connection opening of the fluid discharge conduit is arranged at a height which is higher than 10% of the height of the raised rubber dam from the riverbed. It is preferable to locate the connection opening near at the uppermost end portion of the raised rubber dam. The other end of the fluid discharge conduit is extended upwardly with a substantially ascending inclination to prevent the drain from being collected in the fluid discharge conduit. As a result, the drainage is not collected in the pipe line, so that the fluid introduced into the rubber dam can smoothly be discharged therefrom to atmosphere.

In the embodiment shown in FIG. 2, one end of the fluid supply and discharge conduit 12 is connected to an inlet opening 14 provided at that portion of the rubber dam portion 4' which is fitted to the riverside 11 and which is located at the uppermost end at a height of the raised rubber dam 4 and the other end of the conduit 12 is extended upwardly with an ascending inclination and connected through valves $b_1$, $b_2$ to a blower B. The conduit 12 is also connected through a valve $b_3$ provided in a branch pipe 12' to an exhaust opening 16.

The conduit 12 is connected to a branch pipe 12'' interposed between the valves $b_1$ and $b_2$, the other end of the branch pipe 12'' being connected through a valve $b_4$ to the blower B. The branch pipe 12'' is connected through a branch pipe 12''' interposed between the blower B and the valve $b_4$ to a suction opening 17.

To the branch pipe 12'' is connected one end of the fluid supply and discharge conduit 13 through a valve $b_6$.

To that portion of the conduit 12 which is located between the inlet opening 14 and the valve $b_1$ a branch pipe 18 is connected. The branch pipe 18 is provided at the other end thereof with a float valve 19. The float valve 19 is operatively connected to a float 21 disposed in a float chamber 20 located directly below the float valve 19 to open and close an opening 18' of the branch pipe 18. The float chamber 20 is connected to an opening 22 for taking in water from the river or the like and located at a height of substantially the dangerous level at the upper stream side (eventually at the downstream side) above the rubber dam for the purpose of detecting the dangerous water level when the river water level has increased due to the flood or the like. That is, if the river water level has increased and water flows from the inlet opening 22 into the float chamber 20, the float 21 is raised in response to the water level in the float chamber 20 to push upwardly the float valve 19, thereby opening the opening 18'.

The present embodiment of the rubber dam installation according to the invention will operate as follows.

(1) In the case of raising the rubber dam 4:

First, the valves $b_3$, $b_3$, $b_6$ are closed and the valves $b_1$, $b_2$, $b_5$ are open. Then, the blower B is operative to suck in fluid from the suction opening 17. The fluid is supplied under pressure from the suction opening 17 through the valves $b_5$, $b_2$, $b_1$, conduit 12 and inlet opening 14 into the inflation portion 4'a to raise the rubber dam 4. When the fluid is introduced into the inflation portion 4'a, the blower B is stopped and the valves $b_5$, $b_2$, $b_1$ are closed.

(2) In the case of falling the rubber dam 4:

(i) In the case of collapsing the rubber dam by forcedly exhausting the fluid.

First, the valves $b_3$, $b_1$, $b_4$ are closed and the valves $b_5$, $b_2$, $b_6$ are made open. Then, the blower B is operative to supply the fluid under pressure from the suction opening 17 through the conduit 13 into the auxiliary air chamber 7 to project it into the inner wall of the inflation portion 4'a. Then, the valves $b_5$, $b_2$, $b_6$ are closed and the valves $b_1$, $b_4$, $b_3$ are made open. The blower B is operative to discharge the fluid filled in the inflation portion 4'a from the inlet opening 14 through the conduit 12, valves $b_1$, $b_4$, $b_3$ and exhaust opening 16 into atmosphere, thereby collapsing the rubber dam 4.

Figure 5:
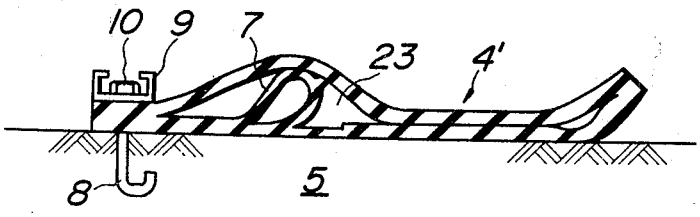
FIG. 5 is a cross-sectional view of the rubber dam body shown in FIG. 4 and partly inflated.

In this case, since the auxiliary air chamber 7 is inflated beforehand, the auxiliary air chamber 7 is projected into the inflation portion 4'a to define a communication gap portion 23 as shown in FIG. 5 irrespective of that position of the rubber dam 4 which tends to start the fall thereof. As a result, there is no risk of the opposed inner walls of the inflation portion 4'a being closely adhered together due to the water pressure subjected to the outside of the rubber dam 4. In addition, the communication gap portion 23 is extended along the inflated auxiliary air chamber 7 in the lengthwise direction thereof up to near the inlet opening 14, so that the fluid remaining in the inflation portion 4'a is passed through the communication gap portion 23 into the inlet opening 14 and then discharged through the conduit 12, valves $b_1$, $b_4$, $b_3$ and exhaust opening 16 into atmosphere. As a result, it is possible to prevent the abnormal fall of the rubber dam 4 due to the influence exerted by the water pressure or the like.

(ii) In the case of automatically collapsing the rubber dam by automatically discharging fluid into atmosphere;

The inflation portion 4' and auxiliary air chamber 7 are inflated beforehand and then all of the valves are closed. Under such condition, the rubber dam 4 is used in practice. If the amount of flow of river water is abnormally increased due to a flood or the like, the water increased flows from the inlet opening 22 into the float chamber 20. As a result, the float 21 rises to push the float valve 19 upwardly, thereby discharging the fluid filled in the inflation portion 4'a from the inlet opening 14 through the conduit 12 branch pipe 18 and opening 18' into atmosphere in a smooth manner. In this case, the auxiliary air chamber 7 functions to completely collapse the rubber dam 4 in the same manner as described above.

As seen from FIG. 2, the conduit 12 for discharging the fluid in the rubber dam 4 is extended upwardly with an ascending inclination, the drainage produced in the conduit 12 is not collected therein, but flows downwardly into the inflation portion 4'a of the rubber dam 4 and collected in the base portion thereof. As a result, in the case of discharging the fluid in the rubber dam 4, the fluid in the inflation portion 4'a can smoothly be discharged without clogging the conduit 12 with the drainage and without extracting the drainage. Thus, the use of the fluid discharge conduit 12 extending upwardly with an ascending inclination ensures a significant effect in the case of automatically falling the rubber dam 4 by automatically discharging the fluid filled therein into atmosphere.

In addition, all of drainage produced in the conduit 12 flows downwardly into the rubber dam 4. Hence exhaust gas from automobiles may be used as a fluid supply source at a remote rubber dam installation site in the mountains.

The drainage collected in the rubber dam 4 functions as a cushion for the collapsed rubber dam and can alleviate damage subjected to the rubber dam 4 due to shocks of rolling stones or the like. It is a matter of course that the drainage collected in the rubber dam 4 can be extracted by forcedly discharging the liquid filled therein.

Figure 6:
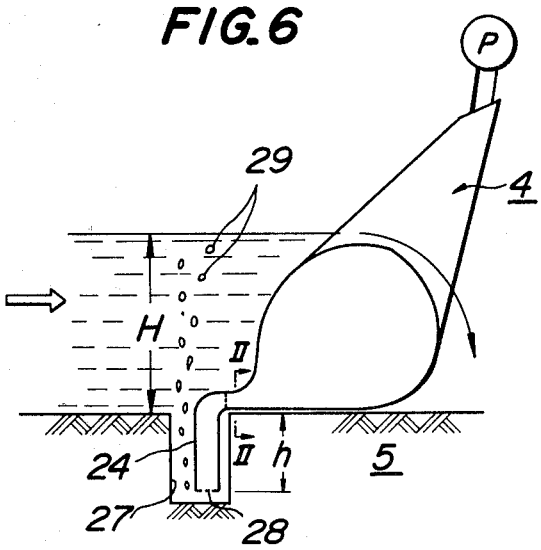
FIG. 6 is a perspective view of a second embodiment of a collapsible rubber dam installation according to the invention, partly shown in section.

FIG. 6 shows a second embodiment of a rubber dam installation according to the invention which is operative irrespective of presence and absence of the drainage collected in the rubber dam and extremely safe in operation. In FIG. 6, a rubber dam 4 is built across a watercourse such as a river or the like and arranged on a riverbed 5. The rubber dam 4 may be composed of a bag-shaped one formed from a rubber sheet at the construction site or may be composed of a belt-shaped one made integral into one body as described above.

In the present embodiment, the rubber dam 4 is provided at that portion thereof which is fitted to the riverbed and located at the upper stream side thereof with an extension pipe 24 projected downwardly from the fitted portion of the rubber dam 1.

Figure 7:
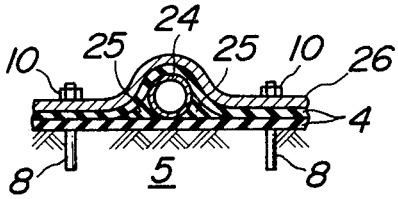
FIG. 7 is a section on line II—II of FIG. 6 in enlarged scale.

As shown in greater detail in FIG. 7, the extension pipe 24 is fitted to the rubber dam 4 as follows. The extension pipe 24 and correction rubber 25 substantially triangular in section and adhered to the lower half periphery of the extension pipe 24 are inserted into the end portion of the rubber dam 4. The cap plate 26 provided at its center portion with a semi-circular portion corresponding to that portion of the rubber dam 4 which is projected upwardly by the insertion of the extension pipe 24 and correction rubber 25 is abutted on the rubber dam 4 under pressure and secured to the riverbed 5 by means of an anchor bolt 8 and nut 10.

The riverbed 5 is provided at that portion into which is projected the extension pipe 24 which a groove 27. The extension pipe 24 is provided at its opening opposed to the base portion of the groove 27 with a filter 28 formed of textile or the like and operative to pass fluid such as water and air or the like, but to prevent sand and mud from passing therethrough.

Use may be made of any suitable number of the extension pipes 24. The number of the extension pipes 24 is determined by the fluid supply ability of the pump P or the like and the amount of fluid to be discharged from the extension pipe 24. It is preferable to make a length h of the extension pipe 24 project into the groove 27 equal to the order of $0.2 \times H$ where H is a height of the rubber dam 4.

The rubber dam 4 shown in FIG. 6 will be raised as follows;

The extension pipe 24 is filled with the river water when the rubber dam 4 is fallen.

If fluid is supplied into the rubber dam 4 by means of a fluid supply and discharge device such as a pump P or the like, the rubber dam 4 is reliably inflated until its internal pressure arrives at a pressure corresponding to a water level difference h and then raised. If the rubber dam 4 becomes inflated, the river water at the upper stream side of the rubber dam 4 is held by the rubber dam 4. As a result, the water level difference becomes larger than h, thereby further inflating and raising the rubber dam 4.

If the fluid is continuously supplied, the rubber dam 4 is completely raised and its height arrives at H. Even after this time, it is possible to supply a surplus internal pressure corresponding to the water level difference h into the rubber dam 4. If the internal pressure of the rubber dam 4 exceeds a pressure corresponding to the water level difference (H+h), the fluid in the rubber dam 4 is released through the filter 28 provided at the open end of the extension pipe 24 as bubbles 29. As a result, the internal pressure in the rubber dam 4 does not exceed the pressure corresponding to the water level difference (H+h). In addition, when the rubber dam 4 is subjected to excessive pressure, it is possible to release the fluid in the rubber dam 4 through the extension pipe 24 into the river. That is, the extension pipe 24 functions not only as a safety device but also as a drain trap.

As seen from the above, the rubber dam 4 shown in FIG. 6 is capable of effecting its normal raising and falling operations irrespective of the presence and absence of the drain collected therein.

Figure 8:
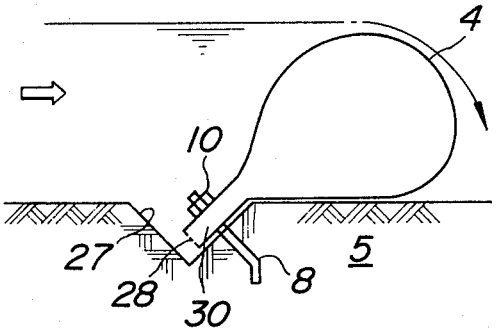
FIG. 8 is a cross-sectional view of a third embodiment of a collapsible rubber dam installation according to the invention.

FIG. 8 shows a third embodiment of a collapsible rubber dam installation according to the invention. In the present embodiment, that portion 30 of the rubber dam 4 which is opposed to the upper stream side thereof is open and directly fitted to the groove 27 V-shaped in section and provided in the riverbed 5 by means of an anchor bolt 8 and nut 10, thereby omitting the extension pipe 24 described with reference to the embodiment shown in FIG. 6. The rubber dam installation constructed according to the present embodiment effectively functions when the amount of water is large.

The rubber dam installation described with reference to FIGS. 6 to 8 has a number of advantages. First, the drainage collected in the rubber dam 4 can easily be extracted when the rubber dam 4 is raised, thereby omitting a special device and operation for extracting the drainage. Secondly, the rubber dam 4 is safe in operation even when the internal pressure becomes excessively high when the fluid is introduced into the rubber dam 4 and when the raised rubber dam 4 is subjected to the excessively high pressure by the large amount of river water at the upper stream side thereof. Third, it is possible to note the inflation and completion of the rubber dam 4 by generation of bubbles 29. Fourth, the water introduced into the rubber dam 4 when the rubber dam 4 is collapsed functions to cushion the shock subjected to the rubber dam 4 by rolling stones struck against it, thereby improving durability of the rubber dam 4. Fifth, it is possible to extract the drainage when the rubber dam is raised. Finally, that portion of the rubber dam 4 which is usually required to be hermetically sealed is made open irrespective of the presence and absence of the drain; as a result, the water pressure at the upper stream side of the river water held by the rubber dam 4 can effectively be utilized for the purpose of raising the rubber dam 4.

Figure 9:
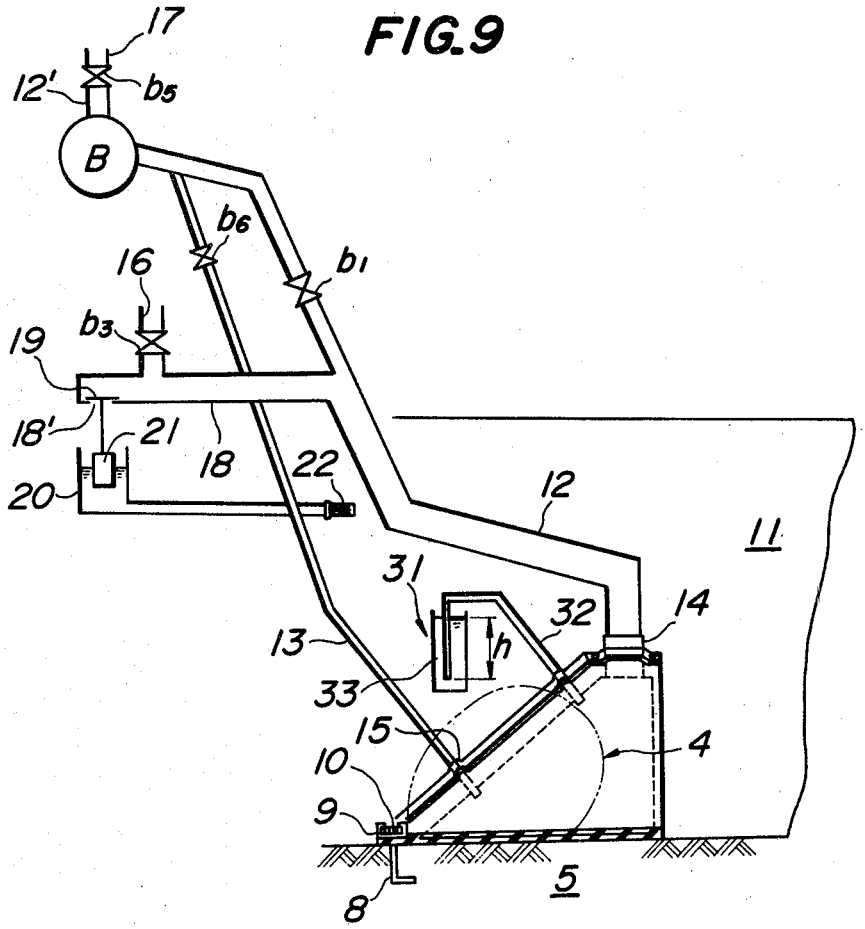
FIG. 9 is a longitudinal cross-sectional view of a fourth embodiment of a collapsible rubber dam installation according to the invention.
Figure 10:
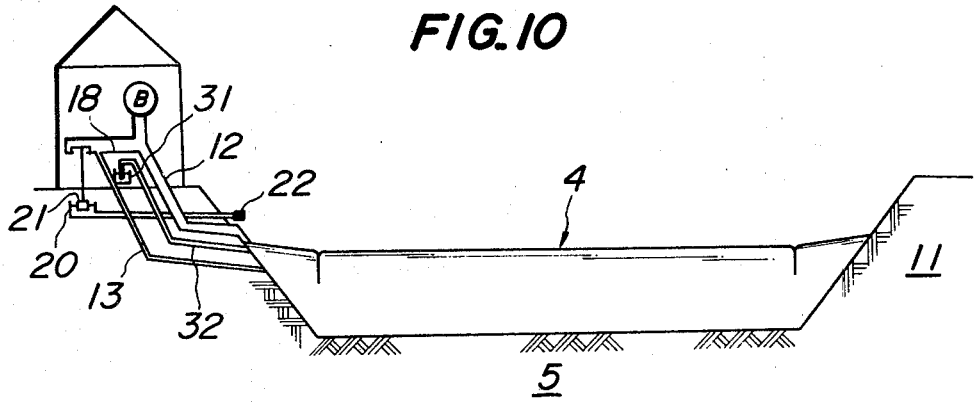
FIG. 10 is a transverse cross-sectional view of the embodiment of FIG. 9.

FIGS. 9 and 10 show a fourth embodiment of a collapsible rubber dam installation according to the invention. In the present embodiment, provision is made of a connection pipe 32 located between the conduits 12 and 13 and for connecting the inflation portion 4'*a* of the rubber dam 4 to a safety device 31. The connecting pipe 32 is not directly connected to the conduits 12 and 13, but is separated therefrom and independent thereof.

The safety device 31 shown in FIG. 9 is composed of a water tank 33 filled with water therein and one end of the connection pipe 32 immersed into the water filled in the water tank 33. A water depth h of the water filled in the water tank 33 is determined so that the internal pressure of the fluid filled in the rubber dam 4 can be controlled. That is, if the internal pressure of the fluid filled in the rubber dam 4 becomes higher than the water pressure corresponding to the water depth h, the internal pressure is released into the safety device 31 in the form of bubbles.

Figure 11:
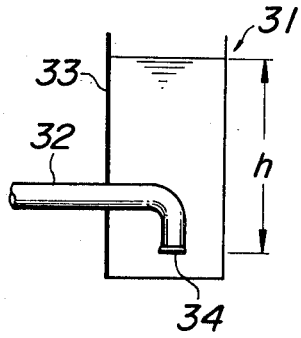
FIG. 11 is a cross-sectional view of another example of the safety device shown in FIG. 9.

FIG. 11 shows another example of the safety device 31 shown in FIG. 9. In the present example, the connection pipe 32 is extended through the lower portion of the water tank 33 and the front end of the connection pipe 32 located in the water tank 33 is bent downwardly and closed with a cover 34 formed of material having a specific gravity which is smaller than that of water. In the present example, if the internal pressure of the fluid filled in the rubber dam 4, that is, the pressure in the connection pipe 32 becomes higher than the water pressure corresponding to the water depth h of the water tank 33, the cover 34 is pushed downwardly to release the internal pressure of the fluid filled in the rubber dam 4 into the water tank 33.

Figure 12:
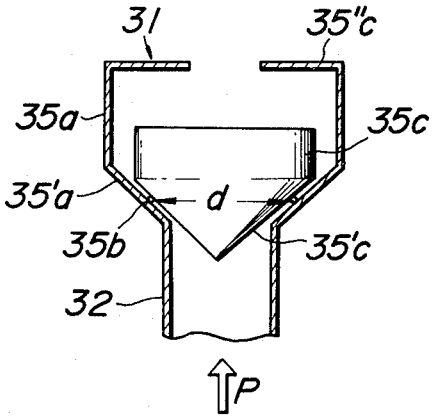
FIG. 12 is a cross-sectional view of a further example of the safety device shown in FIG. 9.

FIG. 12 shows a further example of the safety device 31 shown in FIG. 9. In the present example, a safety device 31 is composed of a connection pipe 32 and its large diameter top portion 35*a*. The large diameter top portion 35*a* encloses a weight 35*c* therein and is connected through a downwardly converging conical surface portion 35'*a* to the connection pipe 32 and provided at its open top surface with a tongue-shaped portion 35''*a*. The weight 35*c* is provided at its lower portion with a downwardly coverging conical surface portion 35'*c* which makes contact through a packing ring 35*b* with the conical surface portion 35'*a* of the large diameter top portion 35*a*. The weight 35*c* may be shaped into any other shapes such as a sphere or the like.

Let the pressure applied to the safety device 31 be P, let the diameter of the contact surface between the connection pipe 32 and the weight 35*c* be d and let the weight of the weight 35*c* be W. Then, if the pressure P takes a value given by $$\frac{4}{\pi d^2} W < P,$$

the weight 35*c* is pushed upwardly to release the internal pressure in the rubber dam 4 to atmosphere.

The operation of the above mentioned fourth embodiment of the rubber dam installation according to the invention with now be described with reference to FIGS. 9 and 10.

(1) In the case of raising the rubber dam 4:

First, valves $b_6$, $b_3$ are closed and valves $b_1$, $b_5$ are open. Then, the blower B is operated to suck in fluid from the suction opening 17. The fluid thus sucked is supplied under pressure through the valve $b_1$, conduit 12 and inlet opening 14 into the inflation portion 4'*a* of the rubber dam 4 to raise it. After the fluid has been supplied into the inflation portion 4'*a*, the blower B is stopped and the valves $b_5$, $b_1$ are closed.

If the internal pressure in the inflation portion 4'*a* exceeds a given value, the safety device 31 operates to communicate the inflation portion 4'*a* with atmosphere. As a result, there is no risk of the rubber dam 4 being broken by the internal pressure therein.

The safety device 31 is connected to the free end of the connection pipe 32 which is separated from the conduit 12 for supplying fluid under pressure into the rubber dam 4. Thus, it is possible to reliably transmit the internal pressure in the rubber dam 4 to the safety device 31 without closing the pressure.

Figure 13:
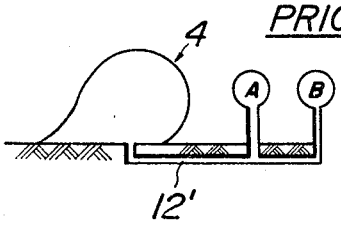
FIG. 13 PRIOR ART
FIG. 13 is a cross-sectional view of a conventional collapsible rubber dam installation.

In the conventional rubber dam installation shown in FIG. 13, a blower B , safety device A and rubber dam 4 communicate with each other by means of a single conduit 12'. As a result, pressures $P_1P_2$, $P_3$ in the blower B, safety device A and rubber dam 4, respectively are given by $$P_1 > P_2 > P_3$$

That is, the pressure $P_2$ applied to the safety device A is different from the internal pressure $P_3$ in the rubber dam 4. As a result, in the conventional rubber dam installation, it is impossible to precisely detect the optimum internal pressure $P_3$ in the rubber dam 4 even if the operative pressure $P_2$ of the safety device A is determined to its optimum value since the internal pressure $P_3$ in the rubber dam 4 is dependent on the length of the conduit 12' and on the supply pressure $P_1$.

On the contrary, in the rubber dam installation according to the invention, the fluid supply conduit 12 and the connection pipe 32 connected to the safety device 31 are independent from each other, so that the blower pressure $P_1$, safety device pressure $P_2$ and internal pressure $P_3$ in the rubber dam 4 are given by $$P_1 > P_2 = P_3$$

That is, the internal pressure $P_3$ in the rubber dam 4 is equal to the pressure $P_2$ subjected to the safety device 31. As a reslt, the operative pressure of the safety device 31 is made equal to the optimum internal pressure in the rubber dam. Thus, the optimum value of the the internal pressure in the rubber dam can easily and reliably be determined.

(2) In the case of falling the rubber dam 4:

First, the valves $b_1$, $b_3$ are closed, whereas the valves $b_5$, $b_6$ are open. Then, the blower B is operated to supply fluid under pressure from the suction opening 17 through the conduit 13 into the auxiliary air chamber 7 to project the auxiliary air chamber 7 toward the inner wall of the inflation portion 4'*a*. Then, the valves $b_5$, $b_6$ are closed, whereas the valve $b_3$ is made open. As a result, the fluid in the inflation portion 4'*a* is released from the inlet opening 14 through the conduit 12, branch pipe 18, valve $b_3$ and exhaust opening 16 to atmosphere, thereby falling the rubber dam 4.

Since the auxiliary air chamber 7 is inflated beforehand, the auxiliary air chamber 7 projected toward the inflation portion 4'*a* functions to form the communication gap portion 23 as shown in FIG. 5 irrespective of that portion of the rubber dam 4 which is fallen. As a result, the opposed internal walls of the inflation portion 4'*a* are prevented from closely adhering together by the water pressure subjected to the outside of the rubber dam 4. In addition, the communication gap portion 23 extends along the inflated auxiliary air chamber 7 in the lengthwise direction thereof up to near the inlet opening 14, so that the fluid remained in the inflation portion 4'*a* is transferred through the communication gap portion 23 to the inlet opening 14 and then is passed through the conduit 12, branch pipe 18 and exhaust opening 16 to atmosphere in a safe manner. As a result, it is possible to prevent the abnormal fall of the rubber dam 4 by the influence of the water pressure or the like exerted thereto.

After the inflation portion 4'*a* and auxiliary air chamber 7 have been inflated as described above, all of the valves are closed and the rubber dam 4 is used. If the amount of flow of the river water becomes abnormally increased due to a flood or the like, the flooded water flows from the inlet opening 22 into the float chamber 20 to rise the float 21 and open the float valve 19. As a result, the fluid in the inflation portion 4'*a* is discharged from the injection opening 14 through the conduit 12, branch pipes 18 and opening 18' to atmosphere in a smooth manner. In this case, it is also possible to completely collapse the rubber dam 4 due to the presence of the auxiliary air chamber 7.

The rubber dam 4 can be collapsed not only by discharging the fluid filled therein to atmosphere but also by forcedly exhausting the fluid by operating the blower B.

As stated hereinbefore, the collapsible rubber dam installation according to the invention makes use of the safety device 31 directly connected to the rubber dam 4 through the connection pipe 32 separated from and independent of the conduit 12 for supplying the fluid into the rubber dam 4. Hence, it can precisely operate in response to the internal pressure in the inflated rubber dam without involving the pressure loss due to the pipe line and can provide a rubber dam having an optimum internal pressure. In addition, even when the rubber dam is raised, the change of the internal pressure in the rubber dam corresponding to the change of the water stream or the like is precisely transmitted to the safety device.

Figure 14:
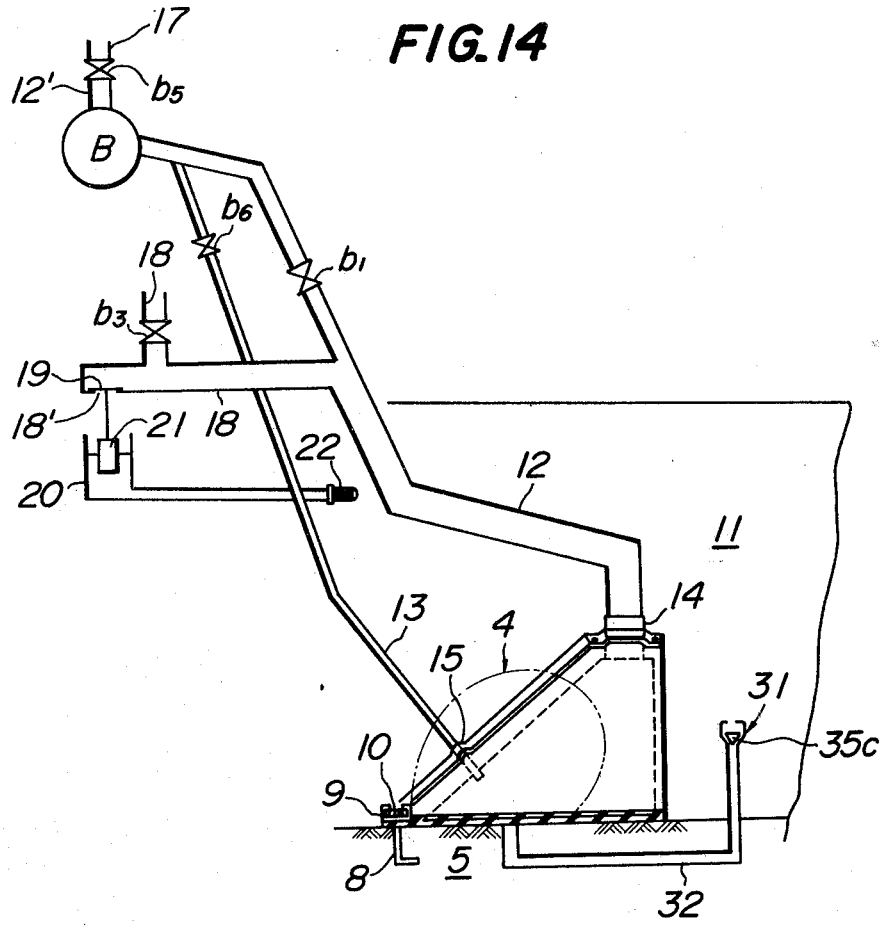
FIG. 14 is a longitudinal cross-sectional view of a fifth embodiment of a collapsible rubber dam installation according to the invention.
Figure 15:
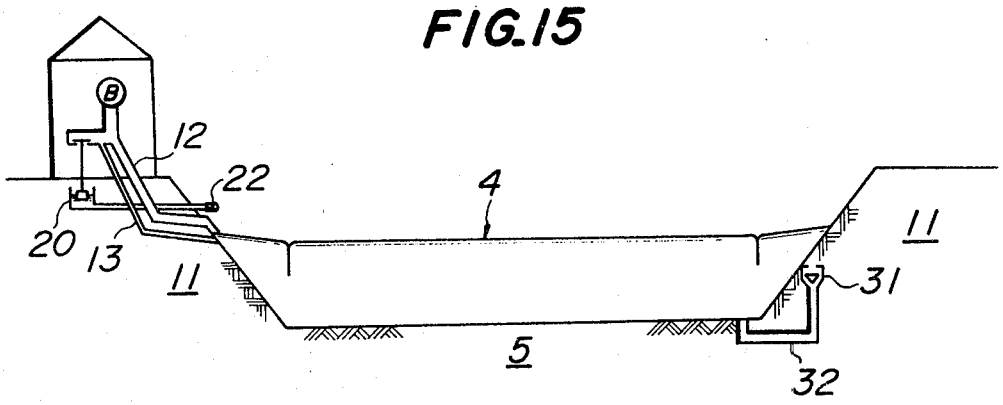
FIG. 15 is a transverse cross-sectional view of the embodiment of FIG. 14.

FIGS. 14 and 15 show a fifth embodiment of a collapsible rubber dam installation according to the invention which makes use of a safety device connected to the base portion of the rubber dam and operative also as a drain trap. In the present embodiment, one end of a connection pipe 32 is opened at the base portion of the rubber dam 4. The connection pipe 32 is extended downwardly from the base portion of the rubber dam 4 and then bent into and extended along a horizontal direction and embedded in the riverbed 5 and finally bent upwardly and made open at an intermediate region of the river-side 11 located at the downstream side of the river. To the open end portion of the connection pipe 32 is fitted the gravity type safety device 31 shown in FIG. 12. In order to connect the connection pipe 32 to the base portion of the rubber dam 4, the rubber dam body 4' is provided at its base portion with a hole into which a flanged nipple connected to one end of a connection pipe 32, is directly inserted.

Figure 16:
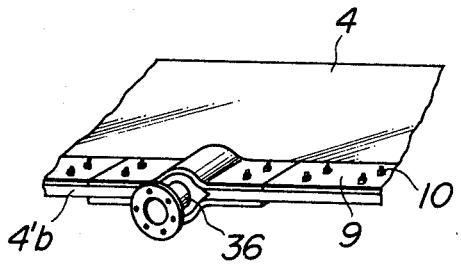
FIG. 16 is a perspective view of a flanged nipple.
Figure 17:
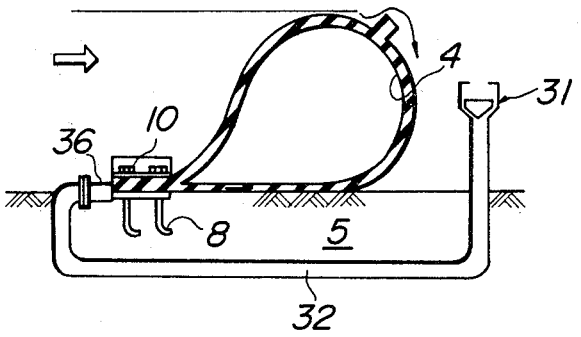
FIG. 17 is a cross-sectional view of the flanged nipple shown in FIG. 16 and for connecting the rubber dam to the safety device shown in FIG. 14.

FIGS. 16 and 17 show such flanged nipple 36 for connecting the rubber dam 4 to the connection pipe 32. The flanged nipple 36 is inserted into the inflation portion 4'a through the plate-shaped portion 4'b located at the upper stream side of the rubber dam 4. To the flanged nipple 36 is connected one end of the connection pipe 32.

FIGS. 18 to 23 show various examples of the safety device 31.

Figure 18A:
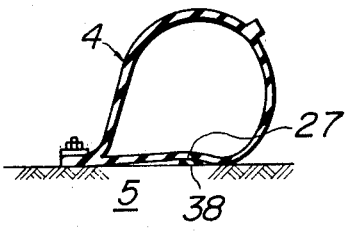
FIGS. 18 to 23 are cross-sectional views of various examples of a safety device.
Figure 18B:
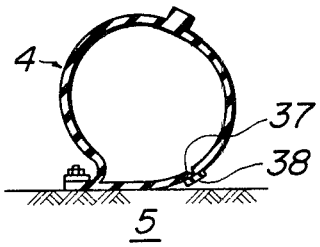

In the safety device shown in FIGS. 18*a* and 18*b*, the rubber dam 4 is provided at its lower riverbed contact portion with a hole 37 which is covered with a flexible plate 38 adhered at the periphery to the hole 37 and operative to open and close the hole 37. As shown in FIG. 18*a*, when the rubber dam 4 is normally raised, the weight of the rubber dam 4 and the shape of the inflation portion formed by the internal pressure cause the flexible plate 38 to completely close the hole 37, thereby preventing the inside of the rubber dam 4 from communicating with atmosphere. If the internal pressure of the rubber dam 4 exceeds its given value, the rubber dam 4 is deformed as shown in FIG. 18*b* to open the hole 37 and communicate the inside of the rubber dam 4 through the open hole 37 with atmosphere.

Figure 19A:
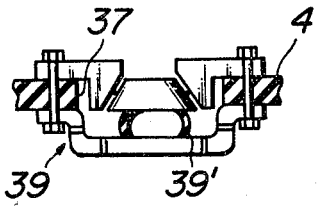
Figure 19B:
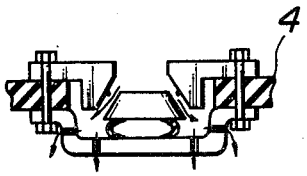
Figure 20A:
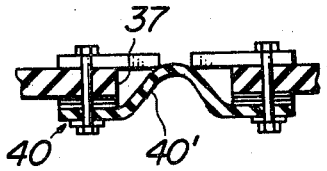
Figure 20B:
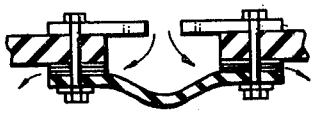
Figure 21A:
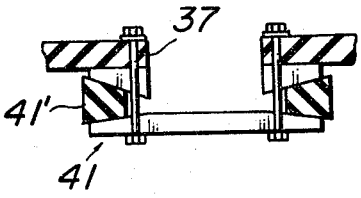
Figure 21B:
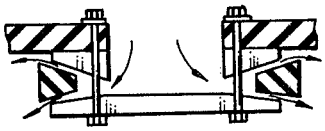

FIGS. 19 to 21 show safety devices 39, 40 and 41 which make use of the elastic force of rubber-like resilient bodies 39', 40' and 41', respectively, for the purpose of opening and closing a hole 37' provided at any desired portion of the rubber dam 4 and adjusting the internal pressure of the rubber dam 4.

Figure 22A:
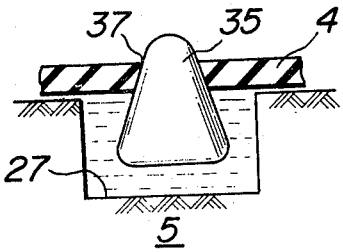
Figure 22B:
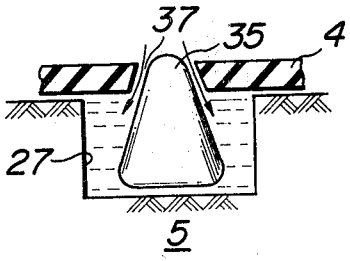

FIG. 22 shows a safety device composed of a float member 35 operative to open and close the opening 37 provided in the base portion of the rubber dam 4 and opposed to the groove 27 provided in the riverbed 5. In the present safety device, the internal pressure in the ruber dam 4 is adjusted by the buoyancy of the float member 35.

Figure 23A:
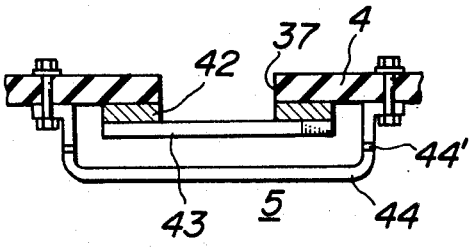
Figure 23B:
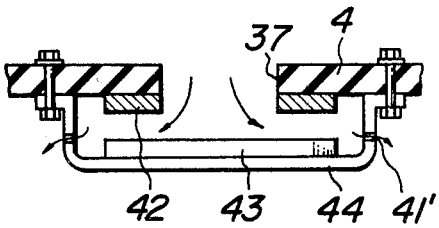

FIGS. 23*a* and 23*b* show another example of a safety device which is composed of an annular permanent magnet 42 secured to the lower peripheral surface of the opening 37 provided at any desired portion of the rubber dam 4. A disc-shaped permanent magnet 43 is operative to be attracted to and separated from the annular permanent magnet 42 for the purpose of adjusting the internal pressure in the rubber dam 4. A cover 44 is used for covering the magnets 42, 43 and provided with openings 44'.

As seen from the above, various kinds of safety devices shown in FIGS. 18 to 23 may be provided at a position directly beneath the rubber dam 4 as opposed to the safety devices 31 shown in FIGS. 9 to 12 which are provided above the rubber dam 4.

The operation of the collapsible rubber dam installation according to the invention provided with the safety devices shown in FIGS. 14 to 23 will now be described with reference to FIGS. 14 and 15.

(1) In the case of raising the rubber dam 4:

The valves are operated in the same manner as with the rubber dam installation shown in FIGS. 9 and 10.

If the internal pressure in the rubber dam 4 exceeds a given value, the safety device 31 becomes operative to communicate the inside of the rubber dam 4 with atmosphere. As a result, there is no risk of the rubber dam 4 being broken by the internal pressure in the rubber dam 4.

At the same time, the drain collected in the rubber dam 4 is discharged through the connection pipe 32 and safety device 31 to atmosphere.

(2) In the case of falling the rubber dam 4:

The valves are operated in the same manner as with the case of the rubber dam installation shown in FIGS. 9 and 10.

When the rubber dam 4 is raised, the pressure of the fluid supplied under pressure thereinto causes the drain collected in the rubber dam 4 to be discharged through the safety device 31 to the outside. That is, the rubber dam installation according to the invention is capable of discharging the drain collected in the rubber dam 4 without effecting any special operation in the case of raising the rubber dam 4.

FIGS. 24 to 27 show a sixth embodiment of a rubber dam installation according to the invention.

Figure 24:
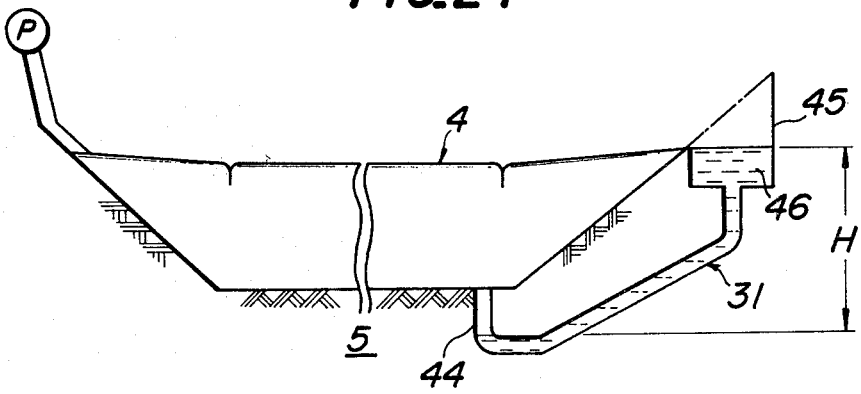
FIG. 24 is a transverse cross-sectional view of a sixth embodiment of a collapsible rubber dam installation according to the invention.

FIG. 24 shows a rubber dam 4 inflated on the riverbed 5 by supplying fluid such as air or the like by means of a gas supply and discharge device such as a pump P or the like.

To the bottom portion of the rubber dam 4 is connected one end of a safety device 31 composed of a conduit 44. The conduit 44 extends downwardly from the bottom surface of the rubber dam 4 and then is bent upwardly to form a substantially U-shaped pipe. To the upper end of the conduit 44 is connected a container 45 having a diameter larger than the diameter of the conduit 44.

The safety device 31 composed of the conduit 44 and the container 45 is filled with liquid 46. For the liquid 46, it is the most economical to use water or river water to be confined by the rubber dam 4.

The container 45 may be opened at the upper stream side or lower stream side of the rubber dam 4. In the present example shown in FIG. 24, the container 43 is opened at the upper stream side of the rubber dam 4 and located near the top surface of the raised rubber dam 4. As a result, a suitable amount of water is always supplied from the opening of the container 45 to the safety device 31. Thus, the safety device 31 shown in FIG. 24 has the advantage that it is not necessary to control the amount of water filled therein. In addition, since the diameter of the container 45 is larger than that of the conduit 44, the liquid 46 can be supplied into the safety device 31 in a stable and quantitative manner.

The operation of the collapsible rubber dam installation shown in FIG. 24 will now be described.

Figure 25:
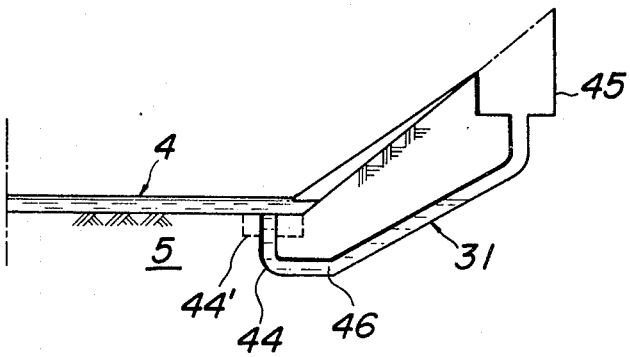
FIG. 25 is a transverse cross-sectional view of the collapsible rubber dam installation shown in FIG. 24 with the rubber dam collapsed.

FIG. 25 shows the rubber dam 4 under its collapsed condition. An amount of water 46 corresponding to the water level difference H shown in FIG. 24 is supplied into the safety device 31. Fluid supply and discharge conduits (not shown) extending upwardly with an ascending inclination cause the drainage produced in the conduits to collect in the rubber dam 4. Since the internal pressure in the fallen rubber dam 4 is equal to the atmospheric pressure, the water levels at the two arms of the U-shaped conduit 44 are the same with each other as shown in FIG. 25.

The water in the safety device 31 shown in FIG. 25 counterflows into the rubber dam 4. If the rubber dam 4 is provided at its base portion with a drain sump pit 44' shown by dotted line, it is possible to guide the drain from the bottom portion of the rubber dam 4 into the safety device 31. In addition, the drain sump pit 44', container 45 and the length of the descending inclination of the conduit 44 are suitably selected such that the rubber dam 4 is collapsed without collecting the drain in the rubber dam 4.

Figure 26:
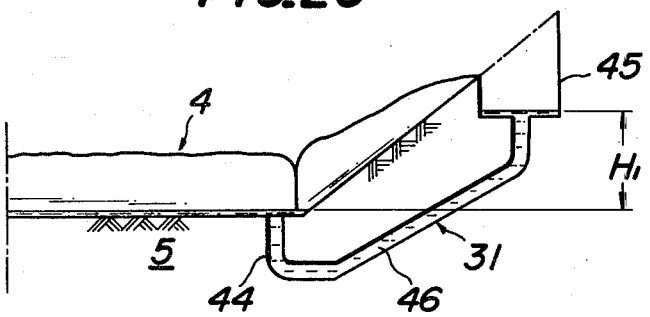
FIG. 26 is a transverse cross-sectional view of the collapsible rubber dam installation shown in FIG. 24 with the rubber dam partly raised.

FIG. 26 shows the rubber dam 4 under its partly inflated condition. In this case, the water level in the safety device 31 becomes out of balance in correspondence with the internal pressure in the rubber dam 4 to produce a water level difference $H_1$ as shown in FIG. 26.

Figure 27:
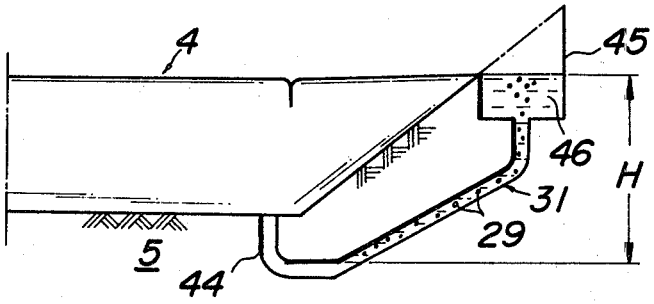
FIG. 27 is a transverse cross-sectional view of the collapsible rubber dam installation shown in FIG. 24 with the rubber dam excessively inflated.

FIG. 27 shows the rubber dam 4 and safety device 31 under which the fluid supplied into the rubber dam 4 exceeds its given internal pressure. In this case, the rubber dam 4 is completely raised and the surplus air passes upwardly through the liquid 46 as bubbles 29 and then discharged from the open portion of the container 45 into atmosphere. When the rubber dam 4 is completely raised, its internal pressure corresponds to the water level difference H.

If the liquid filled in the safety device 31 contains the drain and arrives at a height which is higher than the water level difference H, the surplus amount of liquid overflows the container 45 to make the water level difference constant.

If the diameter of the conduit 44 is large, the surplus fluid is changed into bubbles at the lower portion of the conduit 44, whereas if the diameter of the conduit 44 is small, the surplus fluid is changed into bubbles at the junction between the conduit 44 and the container 45, the bubble generating portion being changed dependent on the pressure of fluid to be supplied into the rubber dam 4. At any rate, the drain overflows from the container 45, so that the safety device 31 shown in FIGS. 24 to 27 can also be used as a drain removing device.

When the water level difference H and generation of bubbles in the safety device 31 show that the pressure in the rubber dam 4 arrives at the given value, the valves (not shown) are closed to stop the supply of fluid into the rubber dam 4. By such operation, the rubber dam 4 can be raised in a safety manner as shown in FIG. 24. In addition, if the amount of water at the upper stream side of the raised rubber dam 4 is increased to increase the pressure subjected to the rubber dam 4, the safety device 31 becomes operative to automatically collapse the rubber dam 4.

Figure 28:
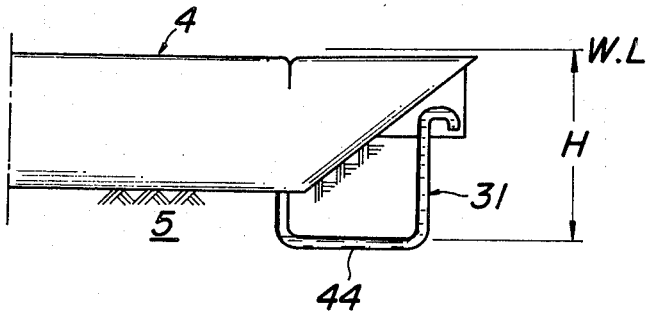
FIG. 28 is a transverse cross-sectional view of a seventh embodiment of a collapsible rubber dam installation according to the invention.

FIG. 28 shows a seventh embodiment of a collapsible rubber dam installation according to the invention. In the present embodiment, the safety device 31 is composed only of a U-shaped conduit 44. One end of the conduit 44 is connected to the bottom portion of the rubber dam 4, whereas the other end is bent downwardly at the upper stream side of the rubber dam 4 and located at a position which is lower than the top surface of the rubber dam 4. The other end of the conduit 44 is bent downwardly for the purpose of preventing foreign matter such as sand or the like from being introduced into the safety device 31.

The safety device 31 shown in FIG. 28 effectively makes use of the water pressure at the upper stream side of the rubber dam 4. That is, the safety device 31 shown in FIG. 28 causes the water pressure at the upper stream side of the rubber dam 4 to play a role of the liquid in the container 45 of the safety device 31 shown in FIG. 24. As a result, the internal pressure in the raised rubber dam 4 corresponds to the water level difference H between the water level WL at the upper stream side of the rubber dam 4 and the lower portion of the U-shaped conduit 44. The safety device 31 constructed as above described is particularly suitable for extracting the drainage collected in the rubber dam 4.

As stated hereinbefore, in the safety device shown in FIGS. 24 and 28, the use of measures of connecting one end of the conduit 44 of the safety device 31 to the bottom surface of the rubber dam 4 ensures an effective extraction of the drain collected in the rubber dam 4 which has heretofore been difficult to be extracted therefrom and the use of measure of making the other end of the conduit 44 upwardly open ensures a positive and efficient utilization of water such as river water or the like which is present by all means at the site of using the rubber dam 4.

What is claimed is:

1. In a collapsible rubber dam installation comprising a rubber dam built across a watercourse such as a river or the like and operative to be raised by supplying fluid into the rubber dam and to be collapsed by discharging the fluid filled therein, the improvement comprising; one end of a fluid supply and discharge conduit being connected to the inside of said rubber dam at a position which is higher than at least a level of drainage collected therein, whereas the other end of said conduit is extended substantially upwardly with an ascending inclination.

2. The collapsible rubber dam installation according to claim 1, wherein at least one portion of the base surface of said rubber dam is made open at the upper stream side of said rubber dam.

3. The collapsible rubber dam installation according to claim 1, wherein said rubber dam is provided at its base portion with a check safety member.

4. The collapsible rubber dam installation according to claim 1, wherein said check safety device is composed of substantially a U-shaped conduit filled with liquid.

5. In a collapsible rubber dam installation comprising a rubber dam built across a watercourse such as a river or the like and operative to be raised by supplying fluid into the rubber dam and to be collapsed by discharging the fluid filled therein, the improvement comprising; one end of a fluid supply and discharge conduit being connected to the inside of said rubber dam at a position which is higher than at least a level of drainage collected therein whereas the other end of said conduit is extended substantially upwardly with an ascending inclination, and said rubber dam further comprises a connection pipe separated from and independently of said conduit for supplying the fluid into the rubber dam, one end of said connection pipe being connected to a safety device and the other end thereof being connected to the inside of the rubber dam.

6. The collapsible rubber dam installation according to claim 5, wherein one end of said connection pipe is opened at the base portion of the rubber dam.

7. The collapsible rubber dam of claim 1, wherein said fluid is air.

8. The collapsible rubber dam of claim 1, wherein said fluid is exhaust gas from an internal combustion engine.

* * * * *